US007571735B2

(12) United States Patent
Wagner

(10) Patent No.: US 7,571,735 B2
(45) Date of Patent: Aug. 11, 2009

(54) NOZZLE FOR ONLINE AND OFFLINE WASHING OF GAS TURBINE COMPRESSORS

(75) Inventor: Thomas Wagner, Troy, NY (US)

(73) Assignee: Gas Turbine Efficiency Sweden AB (SE)

( * ) Notice: Subject to any disclaimer, the term of this patent is extended or adjusted under 35 U.S.C. 154(b) by 72 days.

(21) Appl. No.: 11/540,890

(22) Filed: Sep. 29, 2006

(65) Prior Publication Data

US 2008/0078422 A1 Apr. 3, 2008

(51) Int. Cl.
*B08B 6/00* (2006.01)

(52) U.S. Cl. ..... 134/198; 134/167 R; 134/166 R

(58) Field of Classification Search ..... 134/166 R, 134/167 R, 198
See application file for complete search history.

(56) References Cited

U.S. PATENT DOCUMENTS 5,345,637 A * 9/1994 Pastryk et al. ..... 8/158
5,868,860 A 2/1999 Asplund
2003/0042661 A1* 3/2003 Popjoy ..... 267/64.28
2006/0048796 A1 3/2006 Asplund et al.
2006/0081521 A1 4/2006 Hjerpe et al.

FOREIGN PATENT DOCUMENTS

WO WO 2004/055334 A1 7/2004
WO WO 2005/028119 * 3/2005
WO WO 2005/028119 A1 3/2005
WO WO 2005/120953 A1 12/2005
WO WO 2006/080868 A1 8/2006

* cited by examiner

*Primary Examiner*—Michael Barr
*Assistant Examiner*—Jason Heckert
(74) *Attorney, Agent, or Firm*—DLA Piper LLP (US)

(57) ABSTRACT

A nozzle assembly for cleaning turbines includes an offline cleaning nozzle and a pair of online cleaning nozzles. The offline cleaning nozzle directs cleaning fluid towards the inlet of turbine. The online cleaning nozzles direct a cleaning fluid in a fan-shaped pattern in a direction substantially parallel to the direction of air flow within the turbine's inlet air duct, and intersecting with each other. The longest dimension of the fan-shaped spray pattern is substantially parallel to the direction of air flow within the duct.

21 Claims, 7 Drawing Sheets

NOZZLE FOR ONLINE AND OFFLINE WASHING OF GAS TURBINE COMPRESSORS

FIELD OF THE INVENTION

This invention relates to the washing of gas turbine compressors. More specifically, the invention provides a nozzle with multiple wash function capabilities for washing the gas compressor path of a gas turbine engine.

BACKGROUND

Gas turbines have found a wide use in various applications such as for power generation, for gas compression and many other mechanical drive applications. A gas turbine includes a compressor for compressing ambient air, a combustor burning fuel together with the compressed air and a turbine for driving the compressor. The expanding combustion gases drive the turbine and also result in a net shaft power which may be used for driving a generator, a pump, a compressor, a propeller, or any other device that may be mechanically powered by a rotating shaft.

Gas turbines ingest large quantities of air. With the air follows particles in form of aerosols. Most of the particles exit the gas turbine with the exhaust gases. However, there are particles which may contaminate the compressor gas path of the gas turbine by sticking to the blades and vanes. This contamination also called fouling is most profound in the front end of the gas turbine gas path, i.e. the compressor. The stuck particles will alter the boundary layer air flow over the blades and vanes, thereby changing the aerodynamic properties of the blades and vanes. The changes in aerodynamics result in the gas turbine losing mass flow, thereby reducing the capability of the compressor to compress air, reducing the compressor's efficiency. The compressor of a gas turbine typically consumes 60% of the power available on the shaft. Therefore, a reduction in the compressor efficiency will have a significant impact on the overall performance of the gas turbine. The effects from gas path fouling result in economic losses to the gas turbine operator. It is therefore desired to develop and implement methods and equipment for minimizing fouling.

There are two ways to reduce the effects of fouling. The first is to equip the gas turbine with inlet air filters for reducing contamination that enters the gas path. The second is to wash the particles that are already adhered to the gas path by use of a wash equipment and procedure. In practice, due to the very large quantity of air consumed by a gas turbine, even the best filtering will eventually pass enough contamination for fouling to occur, leading to a need for compressor cleaning.

Washing the gas turbine's gas path on modern gas turbine machines is practiced by injecting a wash liquid upstream of the compressor inlet. By allowing the gas turbine rotor to rotate during wash, the liquid is forced through the compressor and exits at the rear of the gas turbine. The liquid may include water, various chemicals, or a combination thereof. The injection is enhanced by allowing the liquid to be atomized into a fine spray which will distribute the liquid over the entire compressor inlet face. The atomization is provided by nozzles installed permanently on the walls of the air inlet plenum. The liquid is pumped to the nozzles through a pipe or a hose.

Washing is done in two different ways. The most effective way is to wash while the machine is not running at load, but is turning at perhaps 5% of running speed. This mode of washing is called "offline" washing implying that the machine is offline any production. Wash liquid is injected by nozzles directed towards the compressor inlet simultaneously as the machine shaft is slowly being cranked by its starter motor. Fouling is released by the mechanical movements and chemical act of the wash liquid as the liquid slowly moves towards the rear of the machine. This wash method is very effective at restoring the machine performance to prime conditions or near prime conditions. The drawback with the method is if the machine has to be shut down for washing, the cost could be significant for the loss in production revenues.

An alternative wash method is injecting wash liquid as the machine is running. This method is called "online" washing as it implies that the machine is operating in power production mode or in online production. This wash method is not as effective as the offline method for several reasons. First, the online air velocities are very high. A typical air speed at the compressor inlet face is 180 m/s or half the speed of sound. The liquid injection is therefore moved upstream to a position where the air stream is slower and where the liquid is allowed to penetrate into the core of the air stream. Additionally, the turbulence is very strong and liquid is forced towards the walls, where it will not do any good in washing the blades and vanes. Furthermore, the high rotor speed causes liquid impinging on rotor blades to be centrifuged towards the compressor casing where it will not wash the blades. Lastly, the temperature rise within the compressor will soon come to a point where it exceeds the liquid boiling point so that the liquid boils off, disabling any further washing. For a large industrial axial compressor this occurs at about ⅓ of the compressor length. The wash efficacy for online washing is not as good as offline washing due to the difficulties mentioned above and that the wash liquid retention time is very short. Despite the difficulties mentioned, online washing is very popular as it allows washing while the machine production and revenues can be maintained.

The reduced online wash efficacy means that the compressor can be kept clean by daily online washing for a period of time, for example, weeks or months, but build-up of fouling will gradually increase to an unacceptable level. This means that the offline wash capability must also be available to supplement online washing at times when fouling has become significant. Maintaining offline and online wash capability implies one set of nozzles for conducting offline washing and another set of nozzles for conducting online washing. The nozzles will have separate feed lines and valve system making the installation complex and expensive. Further, the maintenance cost will increase.

Additionally, many existing gas turbine installations are currently in place with two nozzle locations to address off line and on line washing needs. These wash applications are typically low pressure (<10 to 15 bar) applications. Such applications have two problems. First, the maintenance of two sets of nozzles is costly, and second, the low pressure application produces a water atomization that is not optimum for cleaning in either the off line or on line conditions.

SUMMARY OF THE INVENTION

The invention provides a nozzle assembly for both online and offline cleaning of turbines. The nozzle assembly includes an offline washing nozzle on the end of the nozzle assembly, structured to direct a cleaning fluid towards an inlet of a turbine when the nozzle is installed in the nozzle opening of an inlet air duct of a turbine. The assembly also includes at least one online washing nozzle on the end of the nozzle assembly. The online washing nozzle is structured to direct a cleaning liquid substantially perpendicular to the direction of air flow within the inlet air duct. A cleaning fluid may selectively be directed through either the online washing nozzle or the offline washing nozzle.

The invention further provides a method of cleaning a turbine. The method includes the use of a single nozzle to direct a cleaning fluid towards the inlet of the turbine during offline washing and to direct the cleaning fluid substantially perpendicular to the direction of air flow within the inlet air duct during online cleaning.

BRIEF DESCRIPTION OF THE DRAWINGS

Like reference characters denote like elements throughout the drawings.

DETAILED DESCRIPTION

The present invention provides a single nozzle assembly that may be used for both offline and online washing of turbines, and that may be installed in locations presently used for offline washing nozzles.

Figure 1:
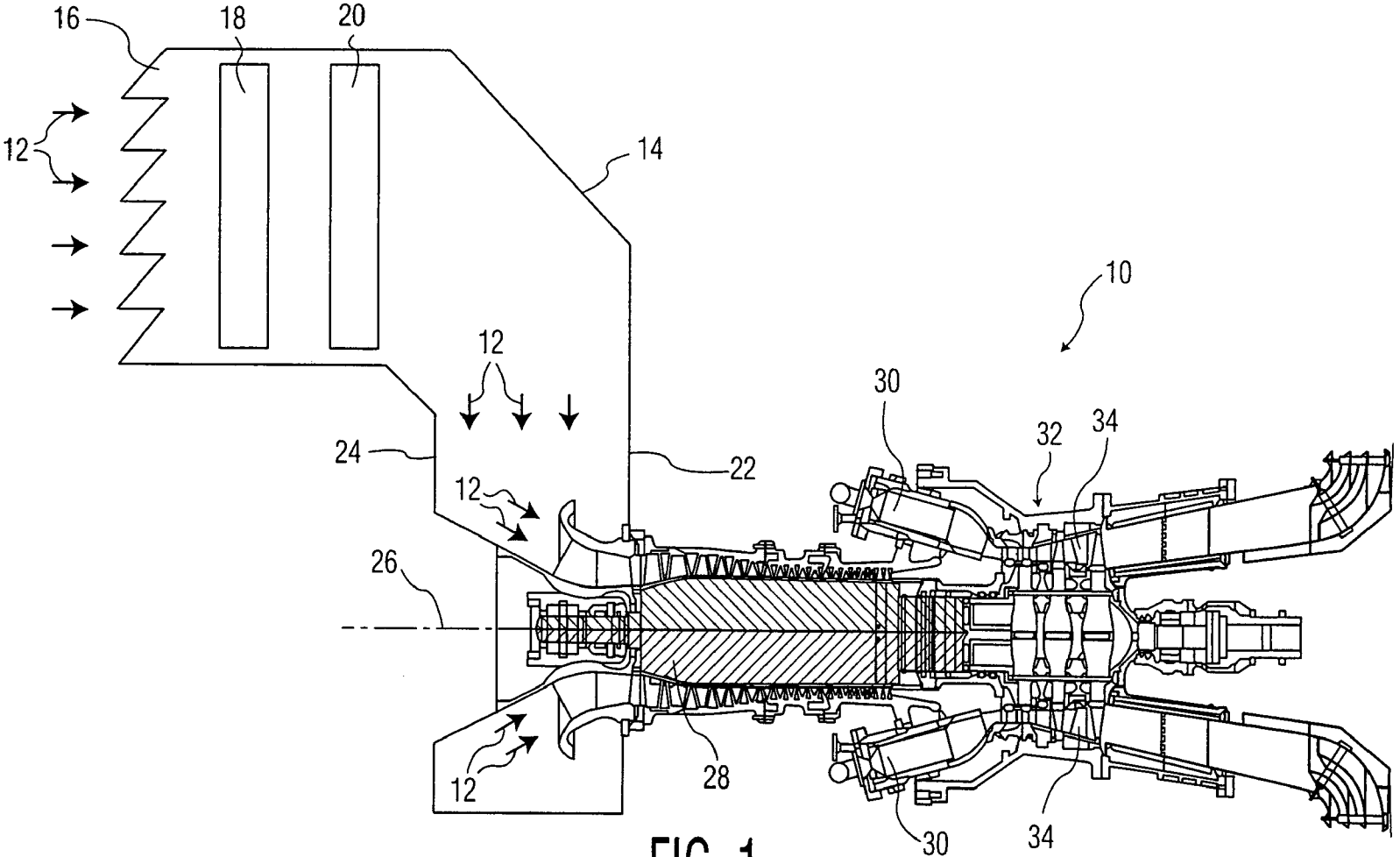
FIG. 1 PRIOR ART
FIG. 1 is a cross-sectional top plan view of an industrial type gas turbine and the upstream inlet air system.

Referring to FIG. 1, a typical gas turbine 10 and the upstream inlet air system 12 are illustrated. Arrows 12 show the direction of the air flow. Air enters an inlet air duct 14 via weather louver 16. The air is filtered in by filter 18 removing most of the air particles. The filtered air enters the inlet air plenum 20 limited by the walls 22, 24 on opposite sides of the air stream. Gas turbine 10 includes a shaft 26 passing therethrough. The forward portion of the shaft 26 drives the blades of a rotor compressor 28. The compressor compresses the air and delivers it to combustor 30 where fuel is fired with the air. The hot combustion gases expand through turbine 32, driving the turbine blades 34, which are attached to the shaft 26. The shaft 26 is thereby rotated, providing rotational mechanical forces for driving other devices, and also supplying rotary power at the back end 36 of the shaft 26. A starter motor, which is not shown but is well understood by those skilled in the art, is used to rotate the shaft 26 during startup of the turbine, and also during offline cleaning of the turbine.

Figure 2:
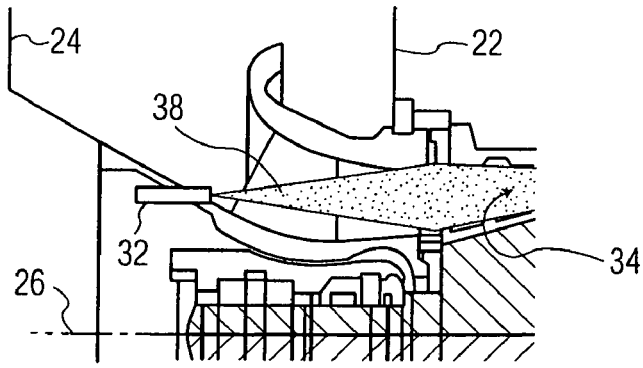
FIG. 2 PRIOR ART
FIG. 2 is a cross sectional view of the inlet air plenum and a nozzle for conduction offline washing according to prior art.

Referring to FIG. 2, prior art offline washing nozzle 32 is installed on wall 24 of the inlet air plenum in a position facing the compressor inlet 34. Nozzle 32 is oriented so that spray 38 emanating from the nozzle 32 is directed towards the compressor inlet face 34 and essentially covers the compressor inlet face 34. As the rotor 26 is slowly cranked by its starter motor the sprayed liquid will penetrate into the compressor interior.

Figure 3:
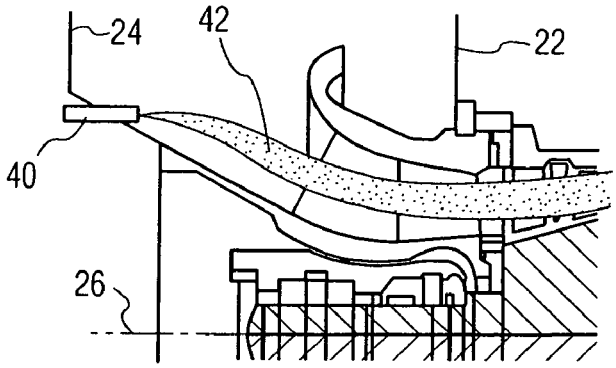
FIG. 3 PRIOR ART
FIG. 3 is a cross sectional view of the inlet air plenum and a nozzle for conduction online washing according to prior art.
Figure 4:
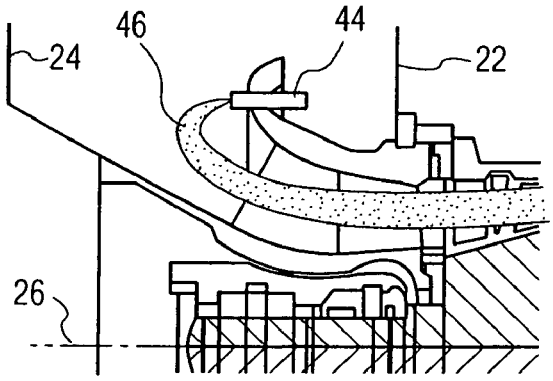
FIG. 4 PRIOR ART
FIG. 4 is a cross sectional view of the inlet air plenum and an alternative placement of a nozzle for conduction online washing according to prior art.

Referring to FIGS. 3-4, prior art online washing is illustrated. An online running condition is characterized by the very high air speed for air entering the compressor 10. FIG. 3 illustrates one example of a prior art online washing nozzle 40. An alternative online washing nozzle 44 illustrated in FIG. 4 is located within the wall 22. The nozzle 40 directs the spray 42 in approximately the same direction as the air flow 12, while the nozzle 44 is structured to direct the spray 46 in a direction that approximately opposes the air flow 12. In either case, the nozzles 40, 44 are located upstream of the offline cleaning nozzle 32, in a location where the air duct 14 is wider than at the location of the offline cleaning nozzle 32. Therefore, the air speed adjacent to the nozzles 40, 44 is slower than the air speed adjacent to the offline washing nozzle 32. The lower air speed allows sprays 42, 46 to penetrate into the core air stream where the droplets are carried with the air stream and enters the compressor inlet 34.

Figure 5:
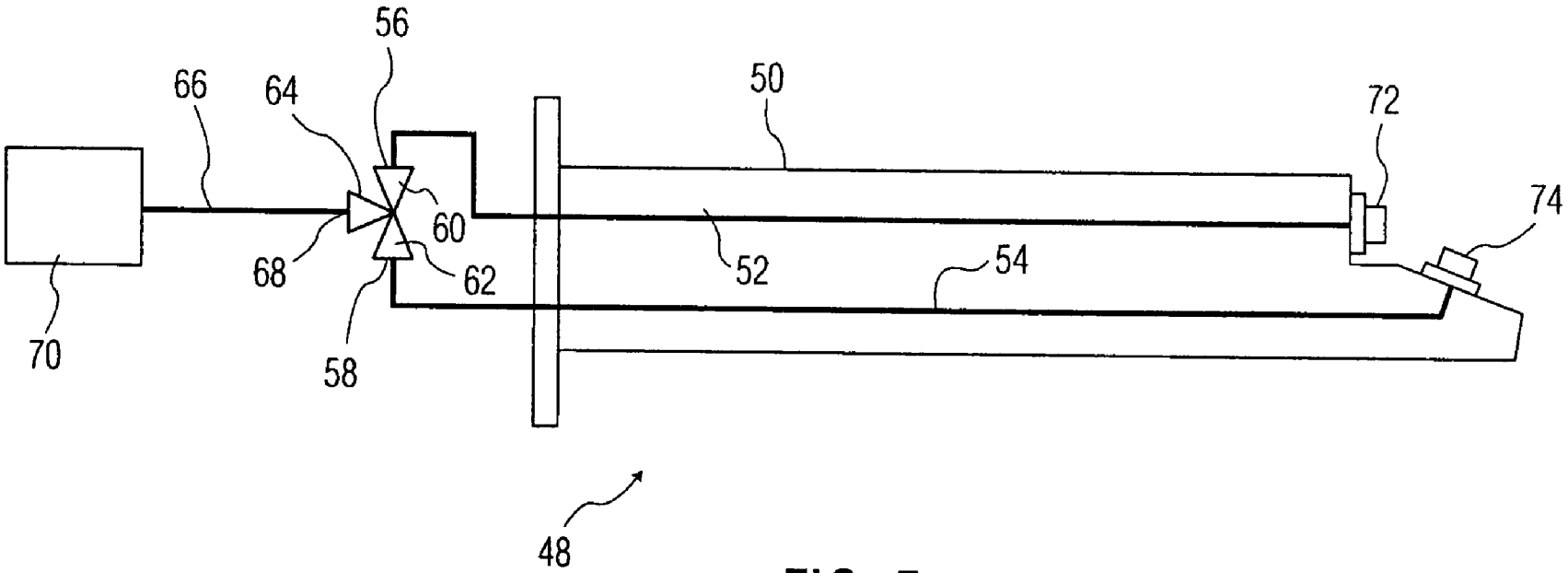
FIG. 5 is a cross sectional front elevational view of a nozzle according to the invention.

FIG. 5 shows the nozzle assembly 48 according to an embodiment of the invention, which is capable of performing both offline washing and online washing. The nozzle assembly 48 may be installed, and in some embodiment preferably installed, in the existing offline nozzle position 49 of the gas turbine 10, for example, the position of the nozzle 32 in FIG. 2. Use of an existing nozzle position facilitates installation on existing gas turbines. This retrofit can easily be conducted at a regular maintenance outage.

Nozzle assembly 48 has a nozzle body 50 with two liquid feed lines 52, 54 housed within the nozzle body 50. The two feed lines 52, 54 are each connected at one end 56, 58 to one outlet 60, 62, respectively, of a three way valve 64. A liquid feed line 66 is connected between the inlet 68 of valve 64 and a pump 70, for example a variable speed pump, for pumping wash liquid. Pump 70 receives liquid from a liquid source that is not shown and well known to those skilled in the art. Valve 64 is therefore structured to route liquid to either feed line 52 or feed line 54, but not both feed lines simultaneously.

The pump 70 is capable of supplying cleaning fluid at a high pressure range, with an example of the range of pressures being at least about 10 bar to about 140 bar, with a more preferable range being about 40 bar to about 140 bar, and even more preferably about 60 bar to about 140 bar. This supply pressure, in conjunction with the nozzle design described herein, facilitates a controlled atomization that enables the cleaning liquid to effectively travel to the fouled compressor blade. This supply pressure further causes the cleaning liquid to scrub the surface without removing base material or coating. Additionally, as explained below, the ability of the pump 70 to supply cleaning liquid at two or more pressure levels within a range of pressures provides a simplified means of switching between offline and online cleaning, as explained below.

The pump 70 can comprise a single pump 70 (if the pump unit is appropriately engineered for that service), one variable speed pump 70 (where the speed is governed by frequency and where the appropriate frequency is set by a frequency controller) or multiple parallel pumps 70, for example, typically five pumps in certain embodiments, each one with different flow capacities. By running one, two or more pumps in different combinations a very large range of pump capacities is accomplished.

The pressurized water emanating from the pump 70 is fed to a supply line 66. The supply line acts as a distributor of the high pressure water to different users such as an evaporative cooling system, a wash system, a compressor intercooling system and a combustor flame cooling system. The pump 70 may be a displacement type pump driven by a frequency controlled electric AC motor, where the frequency governs the pump speed. Alternatively, the pump 70 may include a motor such as a DC motor, where the motor current governs the pump speed. Other suitable pumps 70 are well known to those skilled in the art.

In addition, for washing purposes the use of heated water and chemicals (e.g., for use as washing detergents or as compressor corrosion inhibitors at completion of an operating period) can be advantageous. Therefore, the pump 70 can further include tanks and heaters (i.e., for providing heated water) as well as a chemical injection unit for injecting chemicals into the water.

The pump 70 can be connected to a water collection unit and a water processing unit (i.e., capable of purifying water), since waste water emanates from the gas turbine engine during washing and/or power augmentation. The water processing unit can comprise particle separation filters, de-ionization filters, and/or osmotic filters. For example, the waste water can be in the form of water vapor through the stack or may be produced in a condensed form, where in the case of off-line washing, wash water will flood out from the gas turbine's engine exhaust. This waste water contains any released fouling material as well as oils, fats and metal ions coming from the gas turbine engine itself. This water is typically hazardous and preferably must be collected and treated. Water may also show up in the inlet air duct when evaporative spray cooling is practiced. This water can be collected by the water collection unit and treated in the water processing unit. Alternatively, the water processing unit can also process raw water from a water source (not shown in the Figs.). The treated waste water can be recycled and re-used for washing, thereby providing a closed loop system with no water emissions. Further, the re-used water reduces the total water consumption.

The water processing unit may in some examples purifies the water to "de-mineralized" water quality so that the water is suitable for injection into the gas turbine's air mass path where the total dissolved solids ranges, in certain embodiments, from about 1-5 ppm. Suitable water purifier systems are known to those skilled in the art. Alternatively, the water may be purified to a "deionized" quality.

Pump 70 may in some examples controlled by a control unit. The control unit can be controlled from a control room or from a panel by the pump unit, as examples. The control unit comprises manual controls as well as programmable controls that enable operation of the pump unit via a signal feed. The control unit includes a storage means, for example, a random access memory (RAM) and/or a non-volatile memory such as read-only memory (ROM). One of ordinary skill in the art readily understands that a storage means can include various types of physical devices for temporary and/or persistent storage of data including, but not limited to, solid state, magnetic, optical and combination devices. For example, the storage means may be implemented using one or more physical devices such as DRAM, PROMS, EPROMS, EEPROMS, flash memory, and the like. The storage means can further comprise a computer program product including software code portions for performing the method steps in accordance with embodiments of the invention when the computer program product is run on the computer device, for example, controlling an opening degree of a valve in order to, in turn, control a water flow rate being supplied to at least one nozzle and performing the computational fluid dynamics analysis transfer scheduling to form the control model.

Additionally the supply line 66 and all the conduits can comprise a hydraulic type high pressure flex hose, thus simplifying installation. Alternatively a fixed pipe may be installed. The valve 64 can be opened or closed from the control room or other remote location(s). Alternatively, the valves may be manually opened or closed.

The control unit can also be used to implement computational fluid dynamic transfer analysis (CFD). CFD allows embodiments of the present invention to predict (i.e., form a model) the amount of water needed to be injected into the gas turbine engine to fully saturate or oversaturate the air. CFD provides for a computational model representing the system in accordance with embodiments of the present invention. Subsequently, the dynamics of the fluid flow through the system can be analyzed and predicted in light of one or more of the defined parameters including, but not limited to, the ambient weather conditions and specific parameters pertaining to the gas turbine (i.e., turbine geometry and the velocity field of air movement) and load-limiting design aspects of the turbine (i.e., compressor blades, engine casing, combustor components and hot gas path working elements). CFD provides a control model that is interpreted and implemented by a programmed logic controller (PLC) for adjusting the level of water injection. The defined parameters or boundaries can be input into the system according to embodiments of the present invention either manually or automatically by the use of various sensors and/or weather monitoring units. CFD provides simulated fluid flow and thus, a predicted gas turbine performance level, which corresponds to the air mass flow through the turbine. As a result of the generated model, embodiments of the present invention can adjust the level of water injected on a continual basis or intermittent basis so that the power output of the gas turbine is optimized. The basic CFD process comprises, in one exemplary embodiment, defining the geometry of the gas turbine; determining the volume occupied by the fluid (e.g., water vapor) where the volume is divided into discrete cells (where the totality of the cells form a mesh); defining the boundary conditions such as the particular properties of the fluid utilized (i.e., for those processes that undergo substantially constant changes regarding the defined boundaries, the initial boundaries are typically defined); employing algorithms and equations (i.e., computer software or a computer loadable product loadable onto a digital computing device) for calculating predicted results; interpreting the predicting results to form a model.

If the valve 64 is not controlled by the control unit, then valve 64 may be switched by direct or remote manipulation of the valve 70, or by a pressure switch coupled to feed line 66. Example pressure switches are produced by Norgren or Stahl and open a circuit to activate a valve when a threshold pressure is detected. The pressure switch may be an integral part of the valve 64, or alternatively may be a separate component. The pressure switch is structured so that, when liquid pressure in feed line 66 is lower than a predefined pressure, the valve 64 is opened to feed liquid into the offline feed line 52. When liquid pressure is raised beyond a predefined pressure, the valve is switched so that feed line 52 is closed while the online feed line 54 receives the liquid. The pressure switch may be structured so that online washing is selected when the pressure is set to a level that is at any desired level between about 0.1 to about 0.9 times the maximum operating pressure, and which is more preferably between about 0.5 and about 0.9 times the maximum operating pressure. Switching of the valve 64 is thereby entirely regulated by switching the pump 70 to supply the liquid within the line 66 at a pressure level that is appropriate for the type of cleaning to be performed. This feature simplifies the cost for the wash system and simplifies maintenance.

As another alternative, similar supply pressures may be supplied for online and offline washing, and switching of the valve 64 may be accomplished independently of the pressure supplied by the pump 70. For example, the valve 64 can be actuated by a solenoid system that may be actuated by the above-described control unit.

The other end of feed lines 52, 54 are connected to nozzles 72, 74, 76. Offline washing nozzle 72 is connected to the end of the feed line 52. Likewise, online washing nozzles 74, 76 are connected to the end of the feed line 54. Each of the nozzles 72, 74, 76 define an opening that is structured to atomize the emanating liquid and to shape and inject the spray for achieving the best wash effect.

Figure 6:
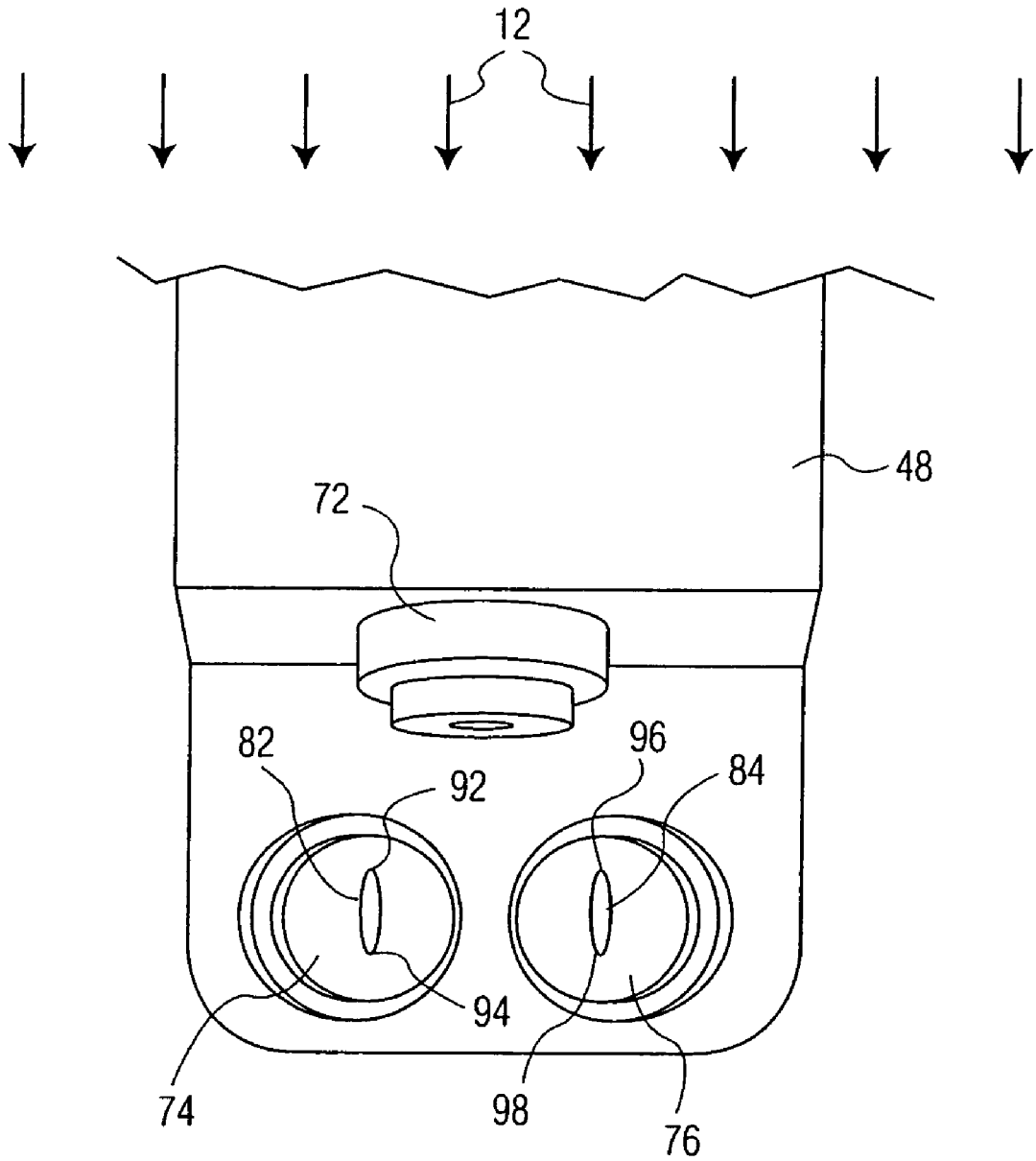
FIG. 6 is a top plan view of an end portion of the nozzle according to the invention
Figure 8:
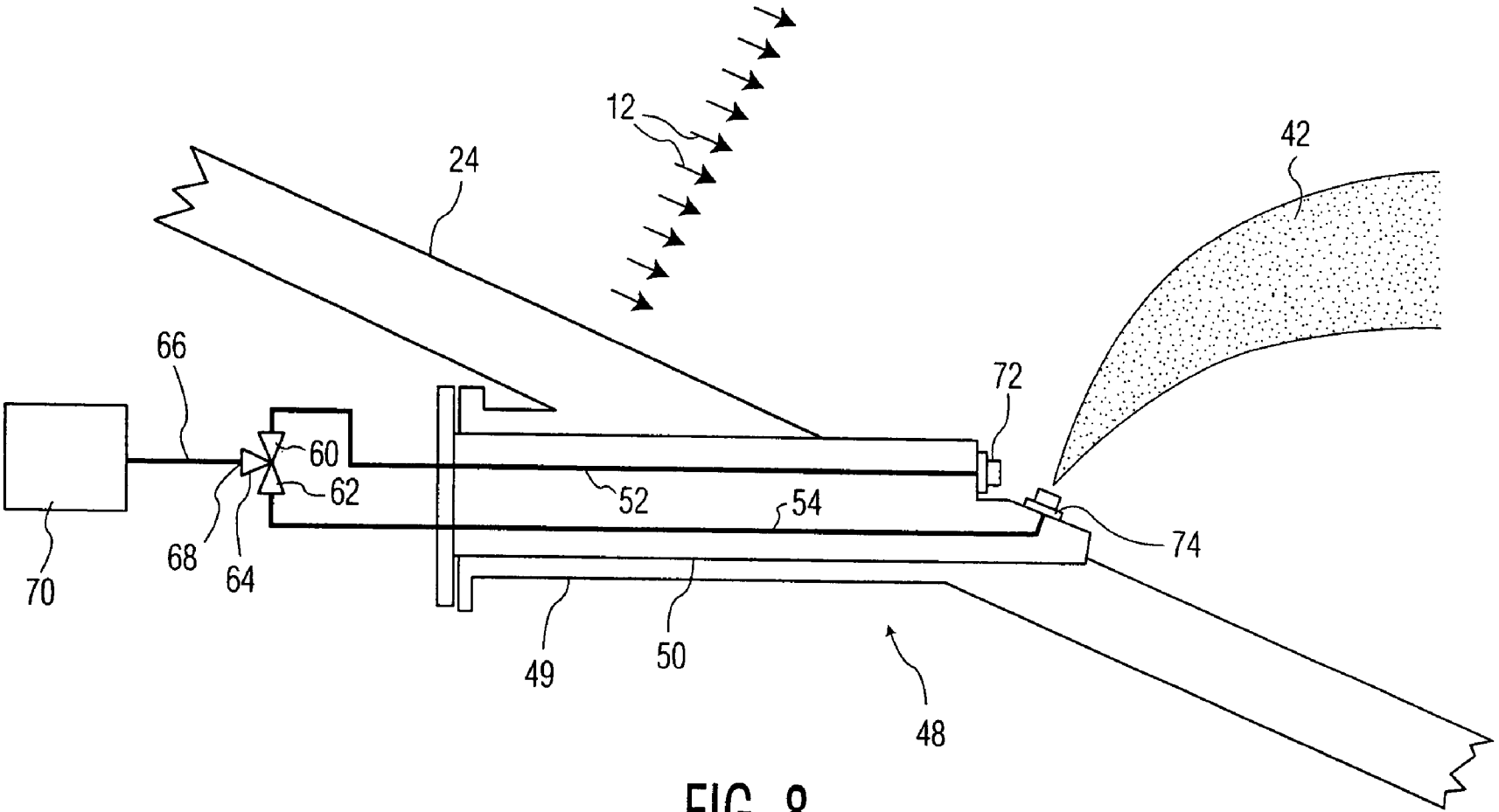
FIG. 8 is a cross sectional front elevational view of the nozzle of FIG. 5, showing the nozzle being used for online washing
Figure 9:
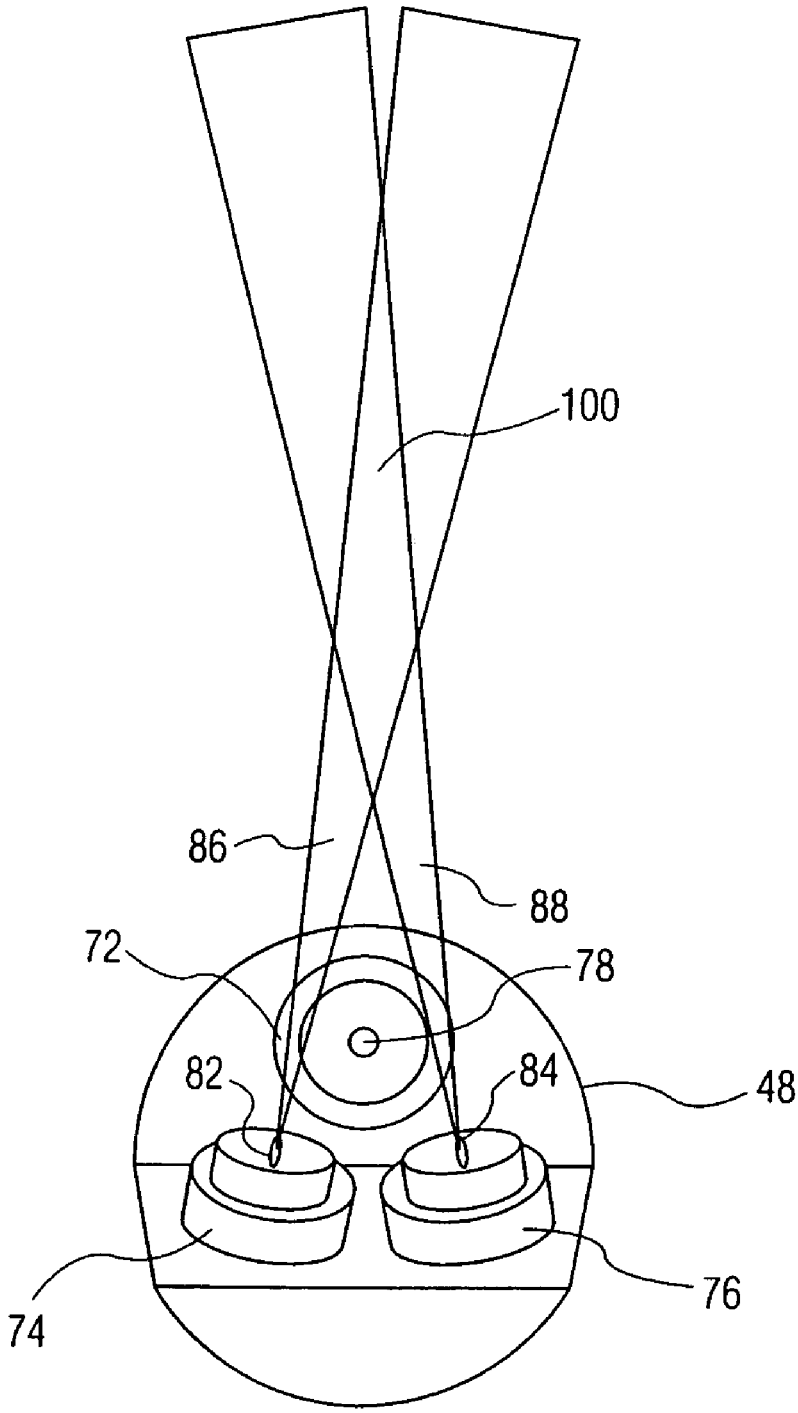
FIG. 9 is a front elevational view of and end portion of the nozzle according to the invention, showing the nozzle being used for online washing.

Referring to FIGS. 6, 8, and 9, the illustrated example of the nozzle 72 defines a generally circular opening 72 that is structured to atomize liquid where the atomized liquid takes shape of a spray of a conical spray pattern or a filled cone spray pattern or a flat fan spray pattern. The illustrated examples of the nozzles 74 and 76 define elongated openings 82, 84 that are structured to atomize liquid where the atomized liquid takes shape of a spray of a flat fan spray pattern. Examples of elongated openings 82, 84 include generally ellipsoidal, generally elliptical or generally rectangular. Ends 92, 94 of opening 82 define the longest axis of the opening 82, while the ends 96, 98 define the longest axis of the opening 84. The atomized spray pattern may be atomized in a manner that results in droplets of 80 to 250 μm in diameter.

The two nozzles 74, 76 have similar spray characteristics, with each generating a spray pattern of a flat fan shape as a result of their elongated shape. A flat fan spray is characterized by having a widthwise droplet distribution and a thicknesswise droplet distribution where the widthwise distribution is greater than the thickness wise distribution. The sprays generated by the openings 82, 84 has widthwise spray distributions coinciding with the longest axis of these openings, which are substantially parallel to the direction of the air flow.

Figure 7:
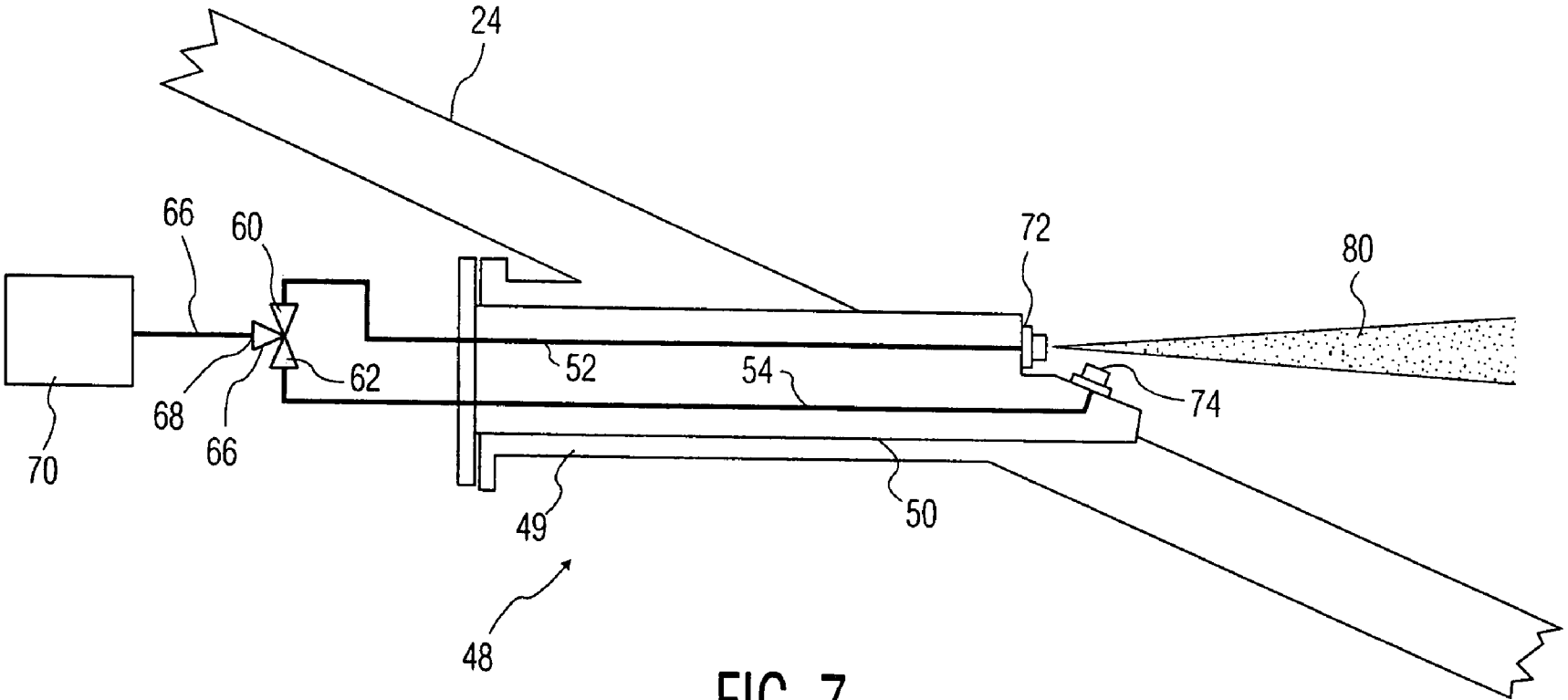
FIG. 7 is a cross sectional front elevational view of the nozzle of FIG. 5, showing the nozzle being used for offline washing

FIG. 7 shows nozzle assembly 48 according to an embodiment of the invention in use for offline washing. If pressure-actuating of the pump 70 is utilized, then pump 70 pumps liquid at a lower pressure, e.g. at about 35 bar (500 psi), actuating valve 64 to direct liquid through feed line 52 to a nozzle 72. Alternatively, a pressure similar to that used for online washing may be supplied by the pump 70, with the valve 64 actuated by other means. Nozzle 72 has an opening 78 (FIG. 9) that may be structured to atomizes the liquid into a narrow angle spray 80 that is directed towards a defined target point on the compressor inlet face. The spray angle is structured to approximately cover the compressor inlet face as the liquid 80 strikes the face. The opening 78 of nozzle 72 allows the liquid to flow at a stipulated flow rate that is suitable for an effective offline wash.

FIG. 8 shows nozzle assembly 48 in use for online washing. Arrows 12 show the direction of the high speed air flow. If pressure actuation of the valve 64 is utilized, then the pump 70 pumps liquid at a higher pressure, e.g. about 70 bar (1000 psi) which is then higher than the pressure required for the valve to switch to offline washing. At the higher pressure valve 64 is now actuated to direct liquid through feed line 54 to nozzles 74, 76 while nozzle 72 receives no liquid. Nozzles 74, 76 are identical but angled differently. Nozzles 74, 76 each have an opening 82, 84 (FIG. 6) structured to atomize the liquid into spray 86, 88. As apparent from FIG. 8 the spray leaving the nozzles 74, 76 is approximately perpendicular to the surface of plenum wall 24, or alternatively angled in a direction at least partially opposing the airstream, and flows at a flow rate that is suitable for an effective online wash.

Referring to FIG. 9, the two sprays 86, 88 of nozzles 74, 76 conducting online washing are illustrated. The two sprays 86, 88 directed so that they intersect within region 100. Within the region 100, the density of the droplets/air mixture is doubled, thus increasing the momentum of the spray. Simultaneously, the projection of the sprays against the air stream is reduced because the narrower thickness dimension is substantially perpendicular to the air stream, and because the two sprays have a common projection area within the region 100. The increased momentum and reduced projection area enables liquid to penetrate into the core air stream during online washing.

Washing may be conducted manually, or alternatively may be performed automatically by configuring the pump 70 so that it may be controlled by a programmable control device such as a microprocessor. The microprocessor may be programmed to conduct online washing at regular intervals and for a desired duration at each time interval during operation of the turbine 10, and to conduct offline washing at times when it is known that the turbine 10 will be shut down.

The present invention therefore provides a single nozzle that may be used for both online and offline cleaning of turbine. The nozzle may be installed within presently existing nozzle openings in the inlet air duct for turbines that are typically used for offline cleaning nozzles. The online cleaning nozzle tips direct a pair of fan-shaped cleaning fluid spray patterns along intersecting paths that are substantially perpendicular to the direction of air flow within the inlet air duct, and which have the longest dimension of the fan shape substantially parallel to the direction of air flow. This spray pattern maximizes the mass of cleaning fluid within a given cross-sectional area of the inlet air duct, thereby maximizing the momentum of the cleaning fluid towards the core of the air flow. The invention further provides a means for directing the cleaning fluid towards either the offline cleaning nozzle or the online cleaning nozzle based on the pressure at which the cleaning fluid is delivered. Selection of the appropriate pressure for a desired type of cleaning automatically delivers the cleaning fluid to the appropriate nozzle for the type of cleaning. Cleaning may, if desired, be actuated automatically by a microprocessor operatively connected to the pump for the cleaning fluid.

A variety of modifications to the embodiments described will be apparent to those skilled in the art from the disclosure provided herein. Thus, the invention may be embodied in other specific forms without departing from the spirit or essential attributes thereof and, accordingly, reference should be made to the appended claims, rather than to the foregoing specification, as indicating the scope of the invention.

What is claimed is:

1. A nozzle assembly for cleaning turbines, the nozzle assembly installed in a nozzle opening on a wall of an inlet air duct of a turbine facing a compressor inlet of the turbine, the nozzle assembly comprising:

a nozzle body;

an offline washing nozzle comprising a nozzle head and disposed on an end of the nozzle body, the offline washing nozzle being structured and positioned to direct a cleaning liquid towards the compressor inlet of the turbine in a direction substantially parallel with airflow within the inlet air duct in an immediate vicinity of the offline nozzle head;

at least one online washing nozzle, each of the at least one online washing nozzles comprising a nozzle head and disposed on the end of the nozzle body, each of the at least one online washing nozzles being structured and positioned to direct a cleaning liquid substantially perpendicular to a direction of airflow within the inlet air duct in an immediate vicinity of the online nozzle heads; and means for selectively supplying the cleaning liquid to either the offline washing nozzle or to the at least one online washing nozzle while resisting fluid flow to the other of the offline washing nozzle and the at least one online washing nozzle.

2. The nozzle assembly according to claim 1, further comprising:

an offline liquid feed line in communication with the offline washing nozzle;

an online liquid feed line in communication with the at least one online washing nozzle;

a liquid supply line in communication with an outlet of a pump; and wherein the means for selectively supplying liquid to either the offline washing nozzle or the at least one online washing nozzle include a three way valve having an inlet in communication with the liquid supply line, a first outlet in communication with the offline liquid feed line, and a second outlet in communication with the online liquid feed line.

3. The nozzle assembly according to claim 2, further comprising a pressure switch operatively connected to the three way valve, the pressure switch being structured to actuate the three way valve to direct fluid to the offline liquid feed line when liquid pressure within the liquid supply line is below a predetermined pressure, and to actuate the three way valve to direct fluid to the online liquid feed line when liquid pressure within the liquid supply line is above the predetermined pressure.

4. The nozzle assembly according to claim 3, wherein the pump is structured to selectively supply liquid to the liquid supply line at either a pressure below the predetermined pressure, or at a pressure above the predetermined pressure; whereby switching the pressure provided by the pump actuates the three-way valve.

5. The nozzle assembly according to claim 3, wherein the pressure switch is included within the three way valve.

6. The nozzle assembly according to claim 3, wherein the pump has an operating pressure between about 40 bar and about 140 bar.

7. The nozzle assembly according to claim 6, wherein the predetermined pressure level is between about 0.5 and about 0.9 times the operating pressure of the pump.

8. The nozzle assembly according to claim 2, further comprising a solenoid operatively connected to the three way valve, the solenoid being structured to actuate the three way valve to direct fluid to the offline liquid feed line, and to actuate the three way valve to direct fluid to the online liquid feed line, the solenoid being operatively connected to a programmable logic controller.

9. The nozzle assembly according to claim 1, wherein each of the at least one online washing nozzles defines an elongated opening therein.

10. The nozzle assembly according to claim 9, wherein the elongated opening is selected from the group consisting of ellipsoidal, elliptical, and rectangular.

11. The nozzle assembly according to claim 9, wherein a longest dimension of the opening defined in each of the at least one online washing nozzles is oriented substantially parallel to a direction of air flow when the nozzle is installed in a nozzle opening of an inlet air duct of a turbine.

12. The nozzle assembly according to claim 1, wherein the at least one online cleaning nozzle includes two online cleaning nozzles.

13. The nozzle assembly according to claim 12, wherein the two online cleaning nozzles are structured to discharge cleaning sprays having generally intersecting paths.

14. The nozzle assembly according to claim 13, wherein each online washing nozzle defines an elongated opening therein.

15. The nozzle assembly according to claim 14, wherein a longest dimension of the opening defined in each online washing nozzle is oriented substantially parallel to a direction of air flow when the nozzle is installed in a nozzle opening of an inlet air duct of a turbine.

16. The nozzle assembly according to claim 1, wherein the nozzle assembly is structured to produce droplets ranging in size from about 80 μm to about 250 μm.

17. A dual nozzle assembly for cleaning turbines, the dual nozzle assembly installed on a wall of an inlet air duct and comprising:

a nozzle body;

an offline washing nozzle comprising a nozzle head and disposed on an end of the nozzle body, the offline washing nozzle structured and positioned to direct a cleaning liquid towards an inlet of a turbine in a direction substantially parallel with airflow within the inlet air duct in an immediate vicinity of the offline nozzle head;

at least two online washing nozzles, each of the at least two online washing nozzles comprising a nozzle head and disposed on the end of the nozzle body, the online washing nozzles structured and positioned to direct a cleaning liquid in an intersecting path that is substantially perpendicular to a direction of airflow within the inlet air duct in an immediate vicinity of each of the online nozzle heads;

means for selectively supplying liquid to either the offline washing nozzle or to the online washing nozzles while resisting fluid flow to the other of the offline washing nozzle or the online washing nozzles.

18. The dual nozzle assembly according to claim 17, wherein a pump supplies the cleaning liquid to the dual nozzle assembly, and wherein the pump is controlled by a control unit that implements computational fluid dynamic transfer analysis to determine the amount of liquid to supply.

19. The dual nozzle assembly according to claim 17, wherein the offline washing nozzle comprises a circular opening structured to atomize the cleaning liquid, wherein the atomized cleaning liquid is in a shape of (i) a conical spray pattern, (ii) a filled cone spray pattern, or (iii) a flat fan spray pattern.

20. The dual nozzle assembly according to claim 17, wherein the at least two online washing nozzles each comprise an elongated opening structured to atomize the cleaning liquid, wherein the atomized cleaning liquid is in a shape of a flat fan spray pattern.

21. The dual nozzle assembly according to claim 20, wherein the atomized cleaning liquid comprises droplets sized between 80 and 250 μm in diameter.

* * * * *